US009530370B2

(12) United States Patent
Yang et al.

(10) Patent No.: US 9,530,370 B2
(45) Date of Patent: Dec. 27, 2016

(54) SHIFT REGISTER UNIT AND DRIVING METHOD THEREOF, GATE DRIVING CIRCUIT AND DISPLAY DEVICE

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Dong Yang, Beijing (CN); Xue Dong, Beijing (CN); Xi Chen, Beijing (CN); Hao Zhang, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 375 days.

(21) Appl. No.: 14/236,185

(22) PCT Filed: Jul. 5, 2013

(86) PCT No.: PCT/CN2013/078915

§ 371 (c)(1),
(2) Date: Jan. 30, 2014

(87) PCT Pub. No.: WO2014/169536

PCT Pub. Date: Oct. 23, 2014

(65) Prior Publication Data

US 2016/0055814 A1 Feb. 25, 2016

(30) Foreign Application Priority Data

Apr. 16, 2013 (CN) ..... 2013 1 0130453

(51) Int. Cl.
*G09G 3/36* (2006.01)

(52) U.S. Cl.
CPC .... *G09G 3/3677* (2013.01); *G09G 2310/0286* (2013.01); *G09G 2310/08* (2013.01); *G09G 2320/02* (2013.01); *G09G 2330/021* (2013.01)

(58) Field of Classification Search
CPC ..... G09G 3/3677
(Continued)

(56) References Cited

U.S. PATENT DOCUMENTS

2010/0201666 A1* 8/2010 Tobita ..... G09G 3/3677 345/208
2012/0256817 A1 10/2012 Chen et al.
(Continued)

FOREIGN PATENT DOCUMENTS

CN 202093782 U 12/2011
CN 102629444 A 8/2012
(Continued)

OTHER PUBLICATIONS

International Search Report for International Application No. PCT/CN2013/078915, 18pgs.
(Continued)

*Primary Examiner* — Amare Mengistu
*Assistant Examiner* — Joseph G Rodriguez
(74) *Attorney, Agent, or Firm* — Ladas & Parry LLP

(57) ABSTRACT

The present disclosure relates to a field of display technology. Provided are a shift register unit and a driving method thereof, a gate driving circuit and a display device. The shift register unit includes an input module, a pull-up module, a pull-down control module and a pull-down module. The turn-on duty ratio of transistors in the shift register unit may be reduced, and the power consumption of the display device product may be reduced.

16 Claims, 7 Drawing Sheets

(58) Field of Classification Search
USPC ..... 345/208, 100
See application file for complete search history.

(56) References Cited

U.S. PATENT DOCUMENTS

| | | | | |
|---|---|---|---|---|
| 2013/0088265 | A1* | 4/2013 | Chen | H03K 5/153 327/108 |
| 2014/0072093 | A1 | 3/2014 | Shang et al. | |
| 2014/0192039 | A1 | 7/2014 | Wang et al. | |

FOREIGN PATENT DOCUMENTS

| | | | |
|---|---|---|---|
| CN | 102651186 | A | 8/2012 |
| CN | 102682727 | A | 9/2012 |
| CN | 102708818 | A | 10/2012 |

OTHER PUBLICATIONS

International Preliminary Report on Patentability Appln. No. PCT/CN2013/078915; Dated Oct. 20, 2015.

* cited by examiner

SHIFT REGISTER UNIT AND DRIVING METHOD THEREOF, GATE DRIVING CIRCUIT AND DISPLAY DEVICE

CROSS REFERENCE TO RELATED APPLICATIONS

This application is based on International Application No. PCT/CN2013/078915 filed on Jul. 5, 2013, which claims priority to Chinese National Application No. 201310130453.1 filed on Apr. 16, 2013, the contents of which are incorporated herein by reference.

TECHNICAL FIELD OF THE DISCLOSURE

The present disclosure relates to a field of display technology, and particularly to a shift register unit and a driving method thereof, a gate driving circuit and a display device.

BACKGROUND

A basic principle for a Thin Film Transistor-Liquid Crystal Display (TFT-LCD) to display a frame of picture is as follows: turning on each row of pixels sequentially from up to down by inputting a certain width of square wave to the row of pixels through a gate driving circuit, and then inputting signals required for the row of pixels sequentially from up to down through a source driving circuit. Currently, when manufacturing a display device with such a configuration, generally, the gate driving circuit and the source driving circuit are manufactured on a glass substrate through a Chip on Film (COF) process or a Chip on Glass (COG) process. However, when the resolution is high, the number of output terminals of the gate driving circuit and the source driving circuit is also large, and the size of the driving circuits is also increased, which has adverse effect on the bonding process of the driving circuits in module.

In order to overcome the above problem, in the manufacture of the existing display device, the design of Gate Driver on Array (GOA) circuit is usually used. Compared to the conventional COF or COG process, the GOA not only has a low cost, but also can achieve an aesthetic symmetrical design on both sides of the display panel while saving the bonding region and the peripheral wiring space for the gate driving circuit, and thus enabling a design of narrow bezel of the display device and improving the productivity and yield of the display device. However, there are some problems in the design of the existing GOA circuit, the turn-on duty ratio of a single TFT in the existing GOA circuit is large, and each TFT is in operational state for a long time, which causes the lifespan of the device in the GOA circuit to be reduced, thereby seriously decreasing the lifespan of the display device product. In addition, the long time operation of the TFT will increase the entire power consumption of the display device. It is difficult to solve these problems in the current GOA circuit.

SUMMARY

In embodiments of the present disclosure, there are provided a shift register unit and a driving method thereof, a gate driving circuit and a display device, which may reduce a turn-on duty ratio of transistors in the shift register unit and thus reduce the power consumption of a display device product.

The particular technical solutions provided in the embodiments of the present disclosure are as follows.

According to one aspect of the present disclosure, there is provided a shift register unit including an input module, a pull-up module, a pull-down control module and a pull-down module, wherein the input module is connected to a first signal input terminal, a second signal input terminal, a first voltage terminal, a second voltage terminal and a pull-up control node, and is used for controlling a level of the pull-up control node according to a signal input from the first signal input terminal and a signal input from the second signal input terminal, wherein the pull-up control node is a connection point of the input module and the pull-up module;

the pull-up module is connected to the pull-up control node, a clock signal input terminal and a signal output terminal, and is used for pulling up a signal output at the signal output terminal to a high level under controls of the pull-up control node and a clock signal input from the clock signal input terminal;

the pull-down control module is connected to a third voltage terminal, the pull-up control node, a first control voltage terminal and a pull-down control node, and is used for turning on the pull-down module according to the pull-up control node and a first control voltage input from the first control voltage terminal, wherein when the shift register unit is in an idle state, the first control voltage controls the pull-down control module to be in a switch-off state, and the pull-down control node is a connection point of the pull-down control module and the pull-down module;

the pull-down module is connected to the pull-down control node, the pull-up control node, the third voltage terminal and the signal output terminal, and is used for pulling down the signal output at the signal output terminal to a low level.

According to another aspect of the embodiments of the present disclosure, there is provided a driving method of shift register unit applied to the above described shift register unit, including:

maintaining by the pull-down module under the control of the pull-down control module that no signal is output from the signal output terminal;

pre-charging the pull-up module by the input module according to the signal input from the first signal input terminal and the signal input from the second signal input terminal;

pulling up the shift register unit by the pull-up module according to the clock signal, such that the output signal at the signal output terminal is at a high level;

pulling down the output signal to a low level by the pull-down module under controls of the pull-down control module and the input module, after the completion of the output of the shift register unit; and controlling the pull-down control module to be in a switch-off state by the first control voltage when the shift register unit is in an idle state.

According to another aspect of the embodiments of the present disclosure, there is provided a gate driving circuit including a plurality of stages of shift register units described above.

Optionally, except a first stage of shift register unit, the signal output terminal of each of stages of shift register units is connected to the second signal input terminal of its adjacent previous stage of shift register unit; and except a last stage of shift register unit, the signal output terminal of each of stages of shift register units is connected to the first signal input terminal of its adjacent next stage of shift register unit.

Optionally, the shift register units for odd-numbered rows are disposed at one side of a display panel, and the shift register units for even-numbered rows are disposed at the other side of the display panel.

Optionally, in the shift register units for the odd-numbered rows disposed at one side of the display panel or in the shift register units for the even-numbered rows disposed at the other side of the display panel, except the first stage of shift register unit and the second stage of shift register unit, a first signal input terminal of each of stages of shift register units and a signal output terminal of a shift register unit with one stage apart are connected together.

Optionally, in the shift register units for the odd-numbered rows disposed at one side of the display panel or in the shift register units for the even-numbered rows disposed at the other side of the display panel, except the last two stages of shift register units, a second signal input terminal of each of stages of shift register units and a signal output terminal of a shift register unit with one stage apart are connected together.

According to another aspect of the embodiments of the present disclosure, there is provided a display device including the gate driving circuit described above.

In the shift register unit and the driving method thereof, the gate driving circuit and the display device provided in the embodiments of the present disclosure, the turn-on duty ratio of transistors in the shift register unit may be effectively reduced, such that the circuit of the shift register unit may operate stably for a long time and may have an improved lifespan, the power consumption of the display device product may be reduced significantly, and the quality of the display device product may be improved.

DETAILED DESCRIPTION

In order to make the purpose, the technical solutions and the advantages of the embodiments of the present disclosure more apparent, hereinafter, the technical solutions in the embodiments of the present disclosure will be described clearly and thoroughly with reference to the accompanying drawings of the present disclosure. Obviously, the embodiments as described are only some of the embodiments of the present disclosure, and are not all of the embodiments of the present disclosure. All other embodiments obtained by those skilled in the art based on the embodiments in the present disclosure without paying any inventive labor should fall into the protection scope of the present disclosure.

Transistors adopted in the embodiments of the present disclosure may be thin film transistors, filed effect transistors, or other devices with the same or similar characteristics. Source and drain of a thin film transistor are not distinguished strictly in the present disclosure since the source and the drain are symmetrical in the transistor structure. In the embodiments of the present disclosure, in order to distinguish two electrodes other than a gate of a transistor, one of two electrodes is referred to as a first electrode and the other is referred to as a second electrode. In addition, transistors may be divided into N-type transistors and P-type transistors according to their characteristics, and descriptions will be given below with taking N-type transistors as an example in the embodiments of the present disclosure. When an N-type transistor is adopted, the first electrode may be a source of the N-type transistor and the second electrode may be a drain of the N-type transistor. It should be understood that another implementation in which P-type transistors are adopted may be easily conceived for those skilled in the art without paying any inventive labor, and thus falls into the protection scope of the present disclosure.

Figure 1:
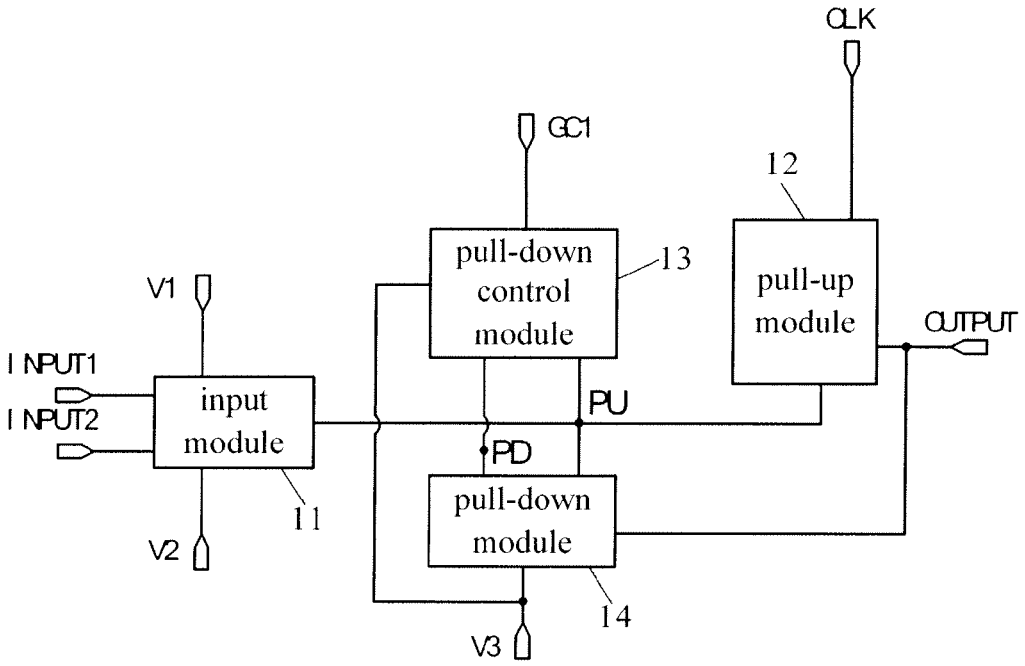
FIG. 1 is a schematic structure diagram of a shift register unit provided in the embodiments of the present disclosure.

As shown in FIG. 1, a shift register unit provided in the embodiments of the present disclosure includes an input module 11, a pull-up module 12, a pull-down control module 13 and a pull-down module 14.

The input module 11 is connected to a first signal input terminal INPUT1, a second signal input terminal INPUT2, a first voltage terminal V1, a second voltage terminal V2 and a pull-up control node PU, and is used for controlling a level at the pull-up control node PU according to a signal input from the first signal input terminal INPUT1 and a signal input from the second signal input terminal INPUT2, wherein the pull-up control node PU is a point connecting the input module 11 and the pull-up module 12.

The pull-up module 12 is connected to the pull-up control node PU, a clock signal input terminal CLK and a signal output terminal OUTPUT, and is used for pulling up a signal output from the signal output terminal OUTPUT to a high level under the controls of the pull-up control node PU and a clock signal input from the clock signal input terminal CLK.

The pull-down control module 13 is connected to a third voltage terminal V3, the pull-up control node PU, a first control voltage terminal GC1 and a pull-down control node PD, and is used for turning on the pull-down module 14 according to the pull-up control node PU and a first control voltage GC1. When the shift register unit is in an idle state, the first control voltage GC1 controls the pull-down control module 13 to be in a switch-off state, wherein the pull-down control node PD is a point connecting the pull-down control module 13 and the pull-down module 14.

It should be noted that the idle state refers to the time when no signal is output from the shift register unit. In the embodiments of the present disclosure, the idle state of the shift register unit may particularly refer to the time when no signal is output from each stage of shift register unit. Then, the first control voltage GC1 is input to each stage of shift register unit via a same signal line, such that the pull-down control module of each stage of shift register unit in the gate driving circuit in the idle state is in a switch-off state.

The pull-down module 14 is connected to the pull-down control node PD, the pull-up control node PU, the third voltage terminal V3 and the signal output terminal OUTPUT, and is used for pulling down the signal output at the signal output terminal OUTPUT to a low level.

In the shift register unit provided in the embodiments of the present disclosure, the turn-on duty ratio of transistors in the shift register unit may be effectively reduced, which ensures that the circuit of the shift register unit may operate stably for a long time and that the lifespan of the circuit of the shift register unit is prolonged, and thus the power consumption of the display device product may be reduced significantly, and the quality of the display device product may be improved.

Particularly, the third voltage terminal V3 may be a ground terminal, or the third voltage terminal V3 inputs a low level VGL.

Figure 2:
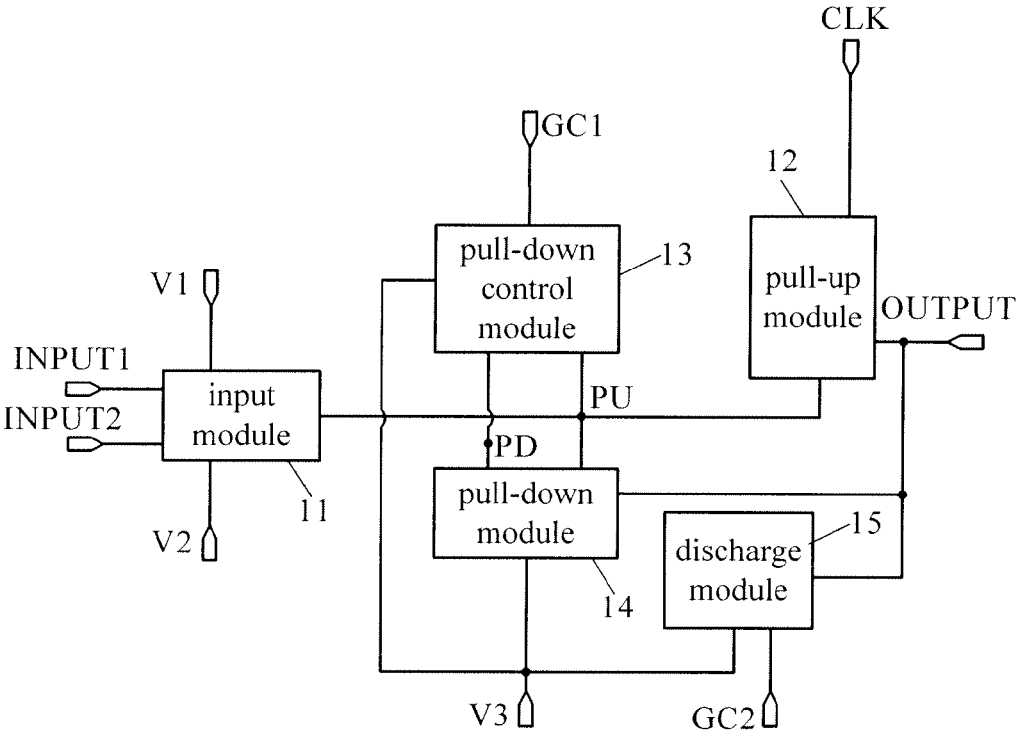
FIG. 2 is a schematic structure diagram of another shift register unit provided in the embodiments of the present disclosure.

Furthermore, as shown in FIG. 2, the shift register unit may further include a discharge module 15, which is connected to the signal output terminal OUTPUT, the third voltage terminal V3 and a second control voltage terminal GC2, and is used for discharging the shift register unit under the control of the second control voltage GC2 when the shift register unit is in an idle state. The idle state of the shift register unit may particularly refer to the time when no signal is output from each stage of shift register unit. Then, the discharge module of each stage of shift register unit may pull down the output of the shift register unit after the completion of the output of the gate driving circuit, such that noise in the gate driving circuit may be released. On the other hand, the discharge module with such a configuration may further perform individual detection for the array or pixel units, which further ensures the lifespan of the circuit of the shift register unit and the stability of long-term operation of the shift register unit.

Figure 3:
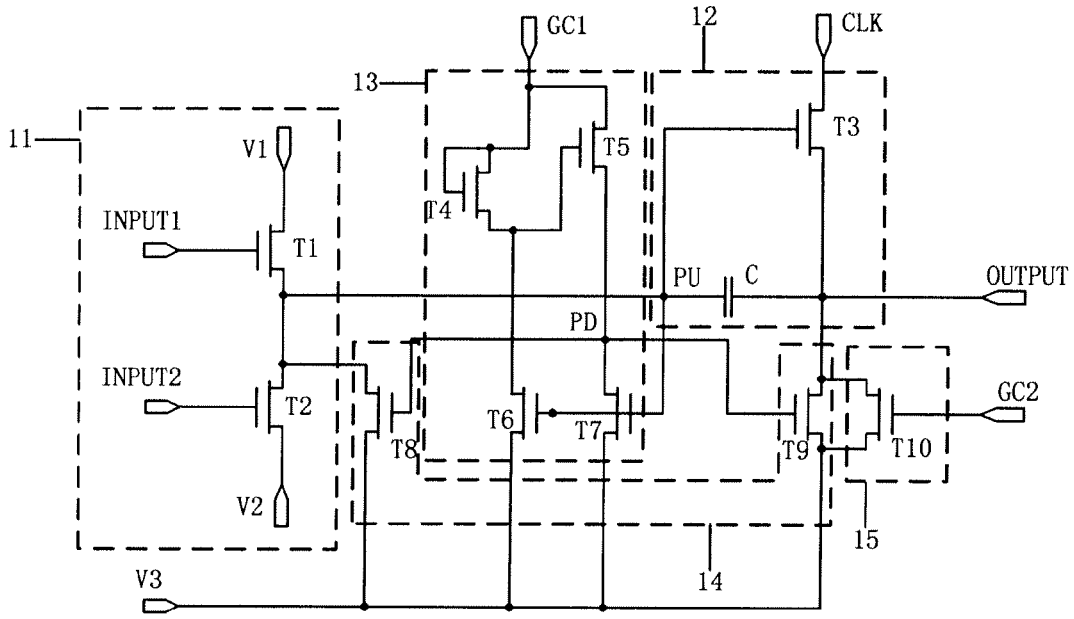
FIG. 3 is a schematic diagram of a circuit connection of a shift register unit provided in the embodiments of the present disclosure.

Furthermore, as shown in FIG. 3, in the shift register unit provided in the embodiments of the present disclosure, the input module 11 may include: a first transistor T1 having a first electrode connected to the pull-up control node PU, a gate connected to the first signal input terminal INPUT1 and a second electrode connected to the first voltage terminal V1; a second transistor T2 having a first electrode connected to the pull-up control node PU, a gate connected to the second signal input terminal INPUT2 and a second electrode connected to the second voltage terminal V2.

In the embodiments of the present disclosure, the pull-up control node PU refers to a circuit node for controlling the pull-up module to be in a switch-on state or a switch-off state. Particularly, the input module 11 functions as determining a level of the pull-up control node PU according to a level of the first signal input terminal INPUT1 and a level of the second signal input terminal INPUT2 and thus determining whether the shift register unit is in an outputting state or a resetting state currently.

When the signal output from an adjacent previous stage of shift register unit and the signal output from an adjacent next stage of shift register unit are used as the input signal to the first signal input terminal INPUT1 and the input signal to the second signal input terminal INPUT2 of a present stage of shift register unit, respectively, the input module 11 with such a configuration may achieve a bi-direction scanning of a gate driving circuit. Particularly, the first signal input terminal INPUT1 can input the signal N−1 OUT output from the adjacent previous stage of shift register unit, and the second signal input terminal INPUT2 can input the signal N+1 OUT output from the adjacent next stage of shift register unit.

When the first voltage terminal V1 inputs a high level VDD and the second voltage terminal V2 inputs a low level VSS, the high level output from the adjacent previous stage of shift register unit can pre-charge the pull-up module 12 via the input module 11, and the high level output from the adjacent next stage of shift register unit can reset the pull-up module 12 via the input module 11.

When the first voltage terminal V1 inputs a low level VSS and the second voltage terminal V2 inputs a high level VDD, the high level output from the adjacent next stage of shift register unit can pre-charge the pull-up module 12 via the input module 11, and the high level output from the adjacent previous stage of shift register unit can reset the pull-up module 12 via the input module 11.

Furthermore, as shown in FIG. 3, the pull-up module 12 may include: a third transistor T3 having a first electrode connected to the signal output terminal OUTPUT, a gate connected to the pull-up control node PU, and a second electrode connected to the clock signal input terminal CLK; and a capacitor C connected in parallel between the gate and the first electrode of the third transistor T3.

In the embodiments of the present disclosure, the pull-up module 12 functions as making the signal output terminal OUTPUT output a high level signal for gate driving during the period that the clock signal is at a high level after the pull-up module 12 is pre-charged.

Furthermore, as shown in FIG. 3, the pull-down control module 13 may include:

a fourth transistor T4 having a gate and a second electrode both connected to the first control voltage terminal GC1;

a fifth transistor T5 having a first electrode connected to the pull-down control node PD, a gate connected to a first electrode of the fourth transistor T4, and a second electrode connected to the first control voltage terminal GC1;

a sixth transistor T6 having a first electrode connected to the third voltage terminal V3, a gate connected to the pull-up control node PU, and a second electrode connected to the gate of the fifth transistor T5;

a seventh transistor T7 having a first electrode connected to the third voltage terminal V3, a gate connected to the pull-up control node PU, and a second electrode connected to the pull-down control node PD.

In the embodiments of the present disclosure, the pull-down control module 13 functions as changing a level of the pull-down control node PD under the control of the first control voltage GC1, wherein the pull-down control node PD refers to a circuit node for controlling the pull-down module to be in a switch-on state or a switch-off state.

Furthermore, as shown in FIG. 3, the pull-down module 14 may include:

an eighth transistor T8 having a first electrode connected to the third voltage terminal V3, a gate connected to the pull-down control node PD, and a second electrode connected to the pull-up control node PU;

a ninth transistor T9 having a first electrode connected to the third voltage terminal V3, a gate connected to the pull-down control node PD, and a second electrode connected to the signal output terminal OUTPUT.

In the embodiments of the present disclosure, the pull-down module 14 functions as particularly, under the control of the output signal of the pull-down control module 13, pulling down the level at the pull-up control node PU and the signal output terminal OUTPUT, respectively, when the pull-down control node PD is at a high level and the clock signal is at a low level. The shift register unit with such a configuration can ensure the release of the circuit noise after completing the output of the gate driving signal, such that the quality of the scanning driving can be improved.

Furthermore, as shown in FIG. 3, the discharge module 15 may include: a tenth transistor T10 having a first electrode connected to the third voltage terminal V3, a gate connected to the second control voltage terminal GC2, and a second electrode connected to the signal output terminal OUTPUT.

In the embodiments of the present disclosure, the discharge module 15 functions as particularly turning on the tenth transistor T10 to release the noise existing at the signal output terminal when the second control voltage GC2 is at a high level.

It should be noted that, in the embodiments of the present disclosure, the first control voltage GC1 and the second control voltage GC2 may adopt periodic signals with opposite phases. For example, the first control voltage GC1 is at a low level and the second control voltage GC2 is at a high level, when the shift register unit is in an idle state; wherein the idle state of the shift register unit may particularly refer to the time when no signal is output from each stage of shift register unit.

In the shift register unit shown in FIG. 3, ten N-type transistors and one capacitor (10T1C) are included. As compared to the prior art, in such a circuit configuration, the number of the devices is relative small, thus significantly simplifying the difficulty of the circuit design and the production, effectively controlling the size of the circuit region and the wiring space, and achieving a design of a narrow bezel of a display device.

In the embodiments of the present disclosure, there is further provided a driving method of shift register unit, capable of being applied to the above described shift register unit, the driving method includes:

maintaining by the pull-down module under the control of the pull-down control module that no signal is output from the signal output terminal;

pre-charging the pull-up module by the input module according to the signal input from the first signal input terminal and the signal input from the second signal input terminal;

pulling up the shift register unit by the pull-up module according to the clock signal, such that the output signal at the signal output terminal is at a high level;

pulling down the output signal to a low level by the pull-down module under the controls of the pull-down control module and the input module, after the completion of the output of the shift register unit;

controlling the pull-down control module to be in a switch-off state by the first control voltage when the shift register unit is in an idle state.

With the driving method of shift register unit provided in the embodiments of the present disclosure, the turn-on duty ratio of the transistors in the shift register unit may be effectively decreased, such that the circuit of the shift register unit may operate stably for a long time and may have an improved lifespan, the power consumption of the display device product may be reduced significantly, and the quality of the display device product may be improved.

Furthermore, the driving method of shift register unit provided in the embodiments of the present disclosure further includes: discharging the shift register unit by the discharge module under the control of the second control voltage when the shift register unit is in the idle state.

It should be noted that the idle state refers to the time when no signal is output from the shift register unit. Particularly, in the embodiments of the present disclosure, the idle state of the shift register unit refers to the time when no signal is output from each stage of shift register units, such that the first control voltage GC1 may be input to each stage of shift register unit through a same signal line, and thus the pull-down control module in each stage of shift register unit in the gate driving circuit in the idle state may reduce the turn-on duty ratio of transistors in the shift register unit, and reduce the power consumption of the display device product. The discharge module can discharge the shift register unit under the control of the second control voltage, and the discharge module in each stage of shift register unit can pull down the output of the stage of shift register unit after the completion of the output of the gate driving circuit, and thus the noise in the gate driving circuit can be released; on the other hand, the discharge module with such a configuration may further perform individual detection for the array or pixel units, which further ensures the lifespan of the circuit of the shift register unit and the stability of long-term operation of the shift register unit.

The shift register unit with such a circuit configuration may achieve a bi-direction scanning of the gate driving circuit by changing the level of the control signals. For example, in the shift register unit as shown in FIG. 3, the first signal input terminal INPUT1 can input the signal N−1 OUT output from the adjacent previous stage of shift register unit, and the second signal input terminal INPUT2 can input the signal N+1 OUT output from the adjacent next stage of shift register unit; as an alternatively, the first signal input terminal INPUT1 can input the signal N+1 OUT output from the adjacent next stage of shift register unit, and the second signal input terminal INPUT2 can input the signal N−1 OUT output from the adjacent previous stage of shift register unit.

When the first voltage terminal V1 inputs a high level VDD and the second voltage terminal V2 inputs a low level VSS, the high level output from the adjacent previous stage of shift register unit can pre-charge the pull-up module 12 via the input module 11, and the high level output from the adjacent next stage of shift register unit can reset the pull-up module 12 via the input module 11.

When the first voltage terminal V1 inputs a low level VSS and the second voltage terminal V2 inputs a high level VDD, the high level output from the adjacent next stage of shift register unit can pre-charge the pull-up module 12 via the input module 11, and the high level output from the adjacent previous stage of shift register unit can reset the pull-up module 12 via the input module 11.

Figure 4:
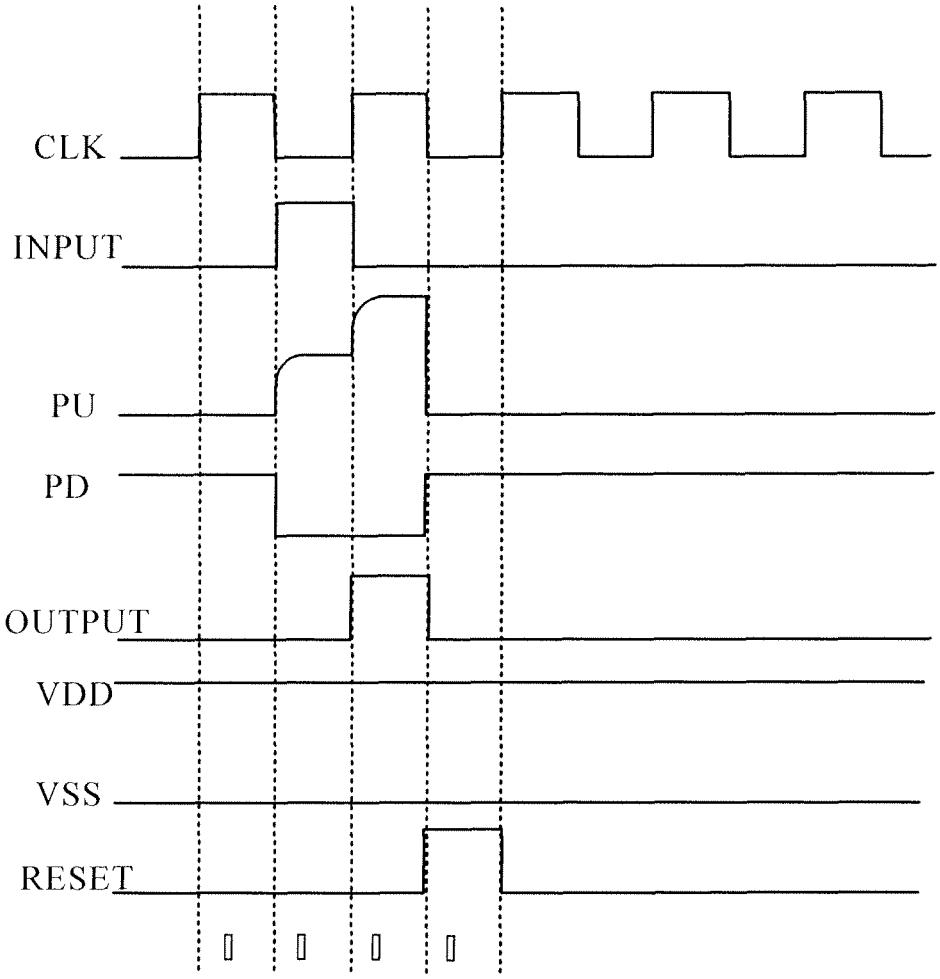
FIG. 4 is a waveform diagram of timing sequences for signals of a shift register unit provided in the embodiments of the present disclosure in operation.

Particularly, the driving method and the operational state of the shift register unit shown in FIG. 3 in the embodiments of the present disclosure may be described in detail in combination with the state diagram of the timing sequence of signals shown in FIG. 4. In such a case, the first voltage terminal V1 inputs a high level VDD, the second voltage terminal V2 inputs a low level VSS, the first signal input terminal INPUT1 inputs a signal INPUT output from the adjacent previous stage of shift register unit, and the second signal input terminal INPUT2 inputs a signal RESET output from the adjacent next stage of shift register unit.

During a first phase, before the shift register unit begins to operate, no signal is input to both the first signal input terminal INPUT1 and the second signal input terminal INPUT2, the first control voltage GC1 is at a high level, the transistors T4 and T5 are in a turn-on state, the pull-down control node PD is at a high level, the transistor T8 and T9 are turned on, the second control voltage GC2 is at a low level, the transistor T10 is turned off, so no signal is output from the signal output terminal OUTPUT at this time.

During a second phase, a signal is input to the first signal input terminal INPUT1, the first voltage terminal V1 inputs a high level VDD, the transistor T1 is in a turn-on state, the level at the pull-up control node PU rises, and a level pre-charge is completed. At this time, the transistors T6 and T7 are turned on, the pull-down control node PD is discharged, and no signal is output from the signal output terminal OUTPUT; wherein the first signal input terminal INPUT1 may input the signal N−1 OUT output from the adjacent previous stage of shift register unit, that is, the shift register unit completes the pre-charge of the pull-up module when the adjacent previous stage of shift register unit outputs a gate driving signal.

During a third phase, the pull-up control node PU is still at a high level at this time, and thus the pull-down control node PD is at a low level, the transistor T3 is turned on, the clock signal arrives at this time, the level at the pull-up control node PU is pulled up due to the bootstrapping effect of the capacitor C, and the signal output terminal OUTPUT outputs a gate driving signal at this time.

During a fourth phase, after the shift register unit completes the output of the gate driving signal, the adjacent next stage of shift register unit repeats the above processes, and the signal N+1 OUT output from the adjacent next stage of shift register unit is input to the second signal control terminal INPUT2 of the shift register unit as a reset signal RESET, the voltage at the pull-up control node PU decreases and the potential at the pull-down control node PD rises, the pull-up control node PU and the signal output terminal OUTPUT are discharged via the transistors T8 and T9, thereby achieving a shift register function.

Furthermore, when the shift register unit is in an idle state, the first control voltage GC1 controls the pull-down control module to be in a switch-off state. For example, the shift register unit is in an operational state during the above phases, the first control voltage GC1 can be at a high level, and the transistors T4 and T5 are both in a turn-on state. During the idle time of the output, the level of the first control voltage GC1 becomes at a low level, and the transistors T4 and T5 are turned off at this time, thus the operation time of the transistors may be reduced and the lifespan of the transistors may be increased.

It should be noted that the idle state refer to the time when no signal is output from the shift register unit. In the embodiments of the present disclosure, the idle state of the shift register unit may particularly refer to the time when no signal is output from each stage of shift register unit, such that the first control voltage GC1 may be input to each stage of shift register unit through a same signal line, and thus the pull-down control module in each stage of shift register unit in the gate driving circuit in the idle state may be in a switch-off state.

Furthermore, when the shift register unit is in an idle state, the discharge module can further discharge the shift register unit under the control of the second control voltage GC2. For example, the shift register unit is in a operational state during the above phases, the second control voltage GC2 is maintained at a low level, and the level of the second control voltage GC2 becomes at a high level when the shift register unit is in an idle state, such that the transistor T10 is turned on to release the noise in the gate driving output of the circuit. Then, the discharge module of each stage of shift register unit can pull down the output of the stage of shift register unit after the completion of the output of the gate driving circuit, and thus the noise in the gate driving circuit can be released; on the other hand, the discharge module with such a configuration may further perform individual detection for the array or pixel units, which further ensures the lifespan of the circuit of the shift register unit and the stability of long term operation of the shift register unit.

In such a manner, the shifting from N−1 OUT of the adjacent previous stage of shift register unit to OUTPUT of the present stage of shift register unit and then to N+1 OUT of the adjacent next stage of shift register unit can be achieved, that is, a gate driving scanning output from up to down can be achieved. It should be noted that, in the embodiments of the present disclosure, the manner of pre-charge and reset can be switched by changing the level of the signal N−1 OUT, the signal N+1 OUT, VDD and VSS, and the bi-direction scan of the gate driving circuit from up to down or from down to up can be achieved.

In the shift register unit provided in the embodiments of the present disclosure, when the shift register unit is in an idle state, the transistors T4 and T5 are turned off under the control of the first control voltage GC1, the turn-on duty ratio of transistors in the shift register unit may be effectively reduced, such that the circuit of the shift register unit may operate stably for a long time and may have an improved lifespan, the power consumption of the display device product may be reduced significantly, and the quality of the display device product may be improved. In addition, in the shift register unit provided in the embodiments of the present disclosure, ten N-type transistors and one capacitor (10T1C) are included. As compared to the prior art, in such a circuit configuration, the number of the devices is relative small, thus significantly simplifying the difficulty of the circuit design and the production, effectively controlling the size of the circuit region and the wiring space, and achieving a design of a narrow bezel of a display device.

Figure 5:
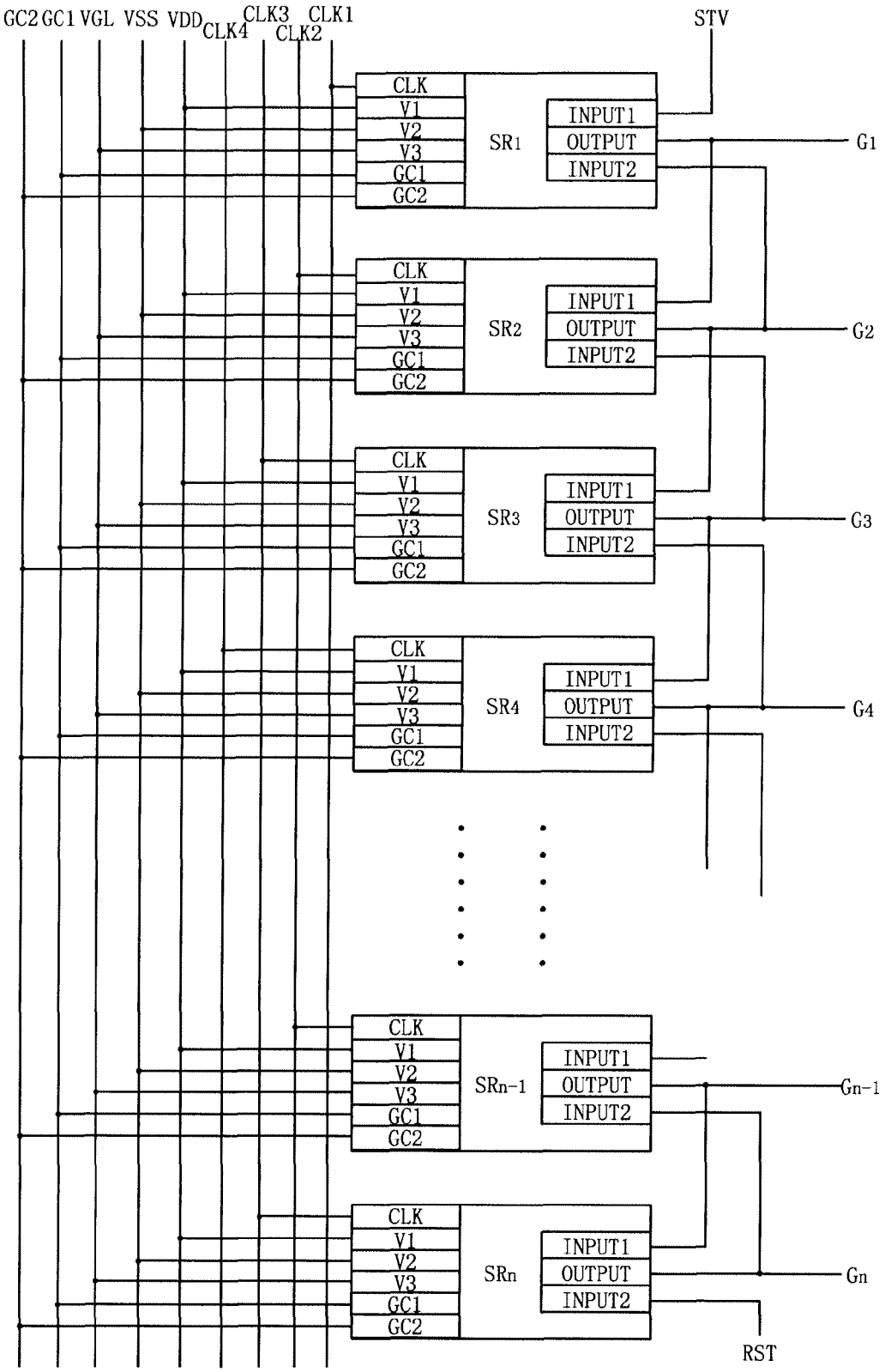
FIG. 5 is a schematic structure diagram of a gate driving circuit provided in the embodiments of the present disclosure.

As shown in FIG. 5, the gate driving circuit provided in the embodiments of the present disclosure includes a plurality of stages of shift register units described above, wherein the output terminal OUTPUT of each stage of shift register unit SR outputs a row scanning signal G of the present stage, and each stage of shift register unit SR has a clock signal input.

Except a first stage of shift register unit SR1, the signal output terminal OUTPUT of each of stages of shift register units is connected to the second signal input terminal INPUT2 of its adjacent previous stage of shift register unit.

Except a last stage of shift register unit SRn, the signal output terminal OUTPUT of each of stages of shift register units is connected to the first signal input terminal INPUT1 of its adjacent next stage of shift register unit.

In the embodiments of the present disclosure, the first signal input terminal INPUT1 of the first stage of shift register unit SR1 can input a frame start signal STV, and the second signal input terminal INPUT2 of the last stage of shift register unit SRn can input a reset signal RST.

The gate driving circuit provided in the embodiments of the present disclosure includes shift register units, such that the turn-on duty ratio of transistors in the shift register unit may be effectively reduced, the circuit of the shift register unit may operate stably for a long time and may have an improved lifespan, the power consumption of the display device product may be reduced significantly, and the quality of the display device product may be improved.

It should be noted that, in order to further increase the scanning frequency of the gate driving circuit, a plurality of groups of clock signals may be input to the shift register units in different rows. For example, in the gate driving circuit as shown in FIG. 5, external clock signal input terminals may include CLK1, CLK2, CLK3 and CLK4, wherein the clock signal input terminal CLK1 is connected to the transistor T3 of the shift register unit in the first row, the clock signal input terminal CLK2 is connected to the transistor T3 of the shift register unit in the second row, and so on; wherein the clock signal input from each clock signal input terminal has a same period but has a different phase. The gate driving circuit is controlled by such clock signals and thus has a higher scanning frequency, and the display quality of the display device may be significantly improved.

Figure 6:
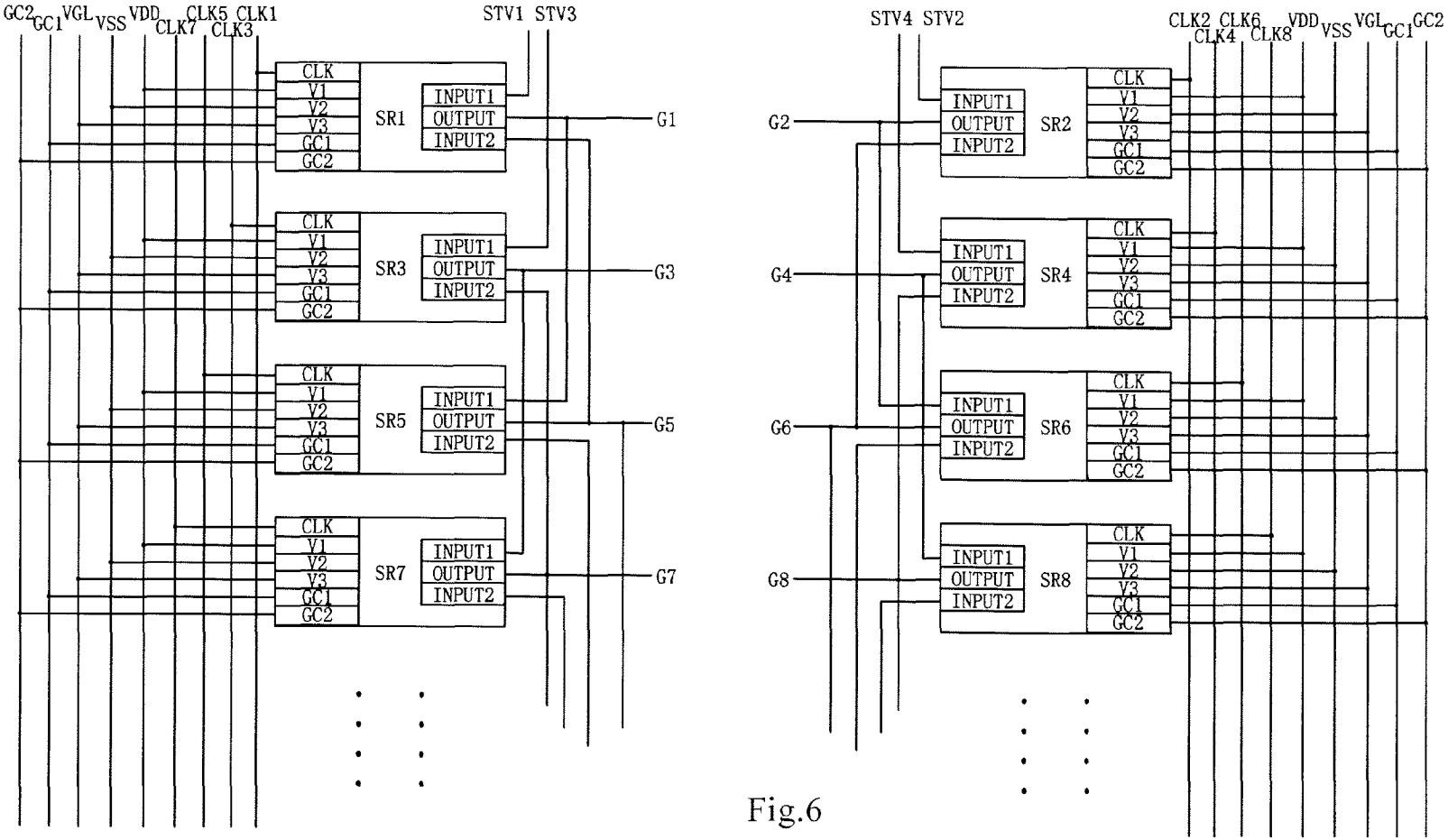
FIG. 6 is a schematic structure diagram of another gate driving circuit provided in the embodiments of the present disclosure.

Furthermore, as shown in FIG. 6, in the gate driving circuit provided in the embodiments of the present disclosure, the shift register units in odd-numbered rows are disposed at one side of a display panel, and the shift register units in even-numbered rows are disposed at the other side of the display panel. Accordingly, the external clock signal input terminals may include eight clock signal input terminals CLK1-CLK8, wherein CLK1, CLK3, CLK5 and CLK1 serve as the external clock signal input terminals connected to the shift register units for the odd-numbered rows, and CLK2, CLK4, CLK6 and CLK8 serve as the external clock signal input terminals connected to the shift register units for the even-numbered rows. Corresponding to the clock signals, the frame start signals STV may likewise include a plurality of groups of frame start signals with different phases. Different frame start signals are input to the first signal input terminals INPUT1 of the corresponding shift register units, respectively. The frame start signals STV1 and STV3 are input to the signal input terminals INPUT1 of the shift register unit SR1 for the first row and the shift register unit SR3 for the third row respectively, and the frame start signals STV2 and STV4 are input to the signal input terminal INPUT1 of the shift register unit SR2 for the second row and the signal input terminal INPUT1 of the shift register unit SR4 for the fourth row respectively.

The output terminal OUTPUT of each stage of shift register unit SR located at one of two sides of the display panel outputs a row scanning signal G for the present stage, and each stage of shift register unit SR has a clock signal input.

In the shift register units for odd-numbered rows located at one side of the display panel or in the shift register units for even-numbered rows located at the other side of the display panel, except the first stage of shift register unit and the second stage of shift register unit, a first signal input terminal INPUT1 of each of stages of shift register units and a signal output terminal OUTPUT of a shift register unit with one stage apart are connected together.

In the shift register units for odd-numbered rows located at one side of the display panel or in the shift register units for even-numbered rows located at the other side of the display panel, except the last two shift register units SRn−1 and SRn, a second signal input terminal INPUT2 of each of stages of shift register units and a signal output terminal OUTPUT of a shift register unit with one stage apart are connected together.

Figure 7:
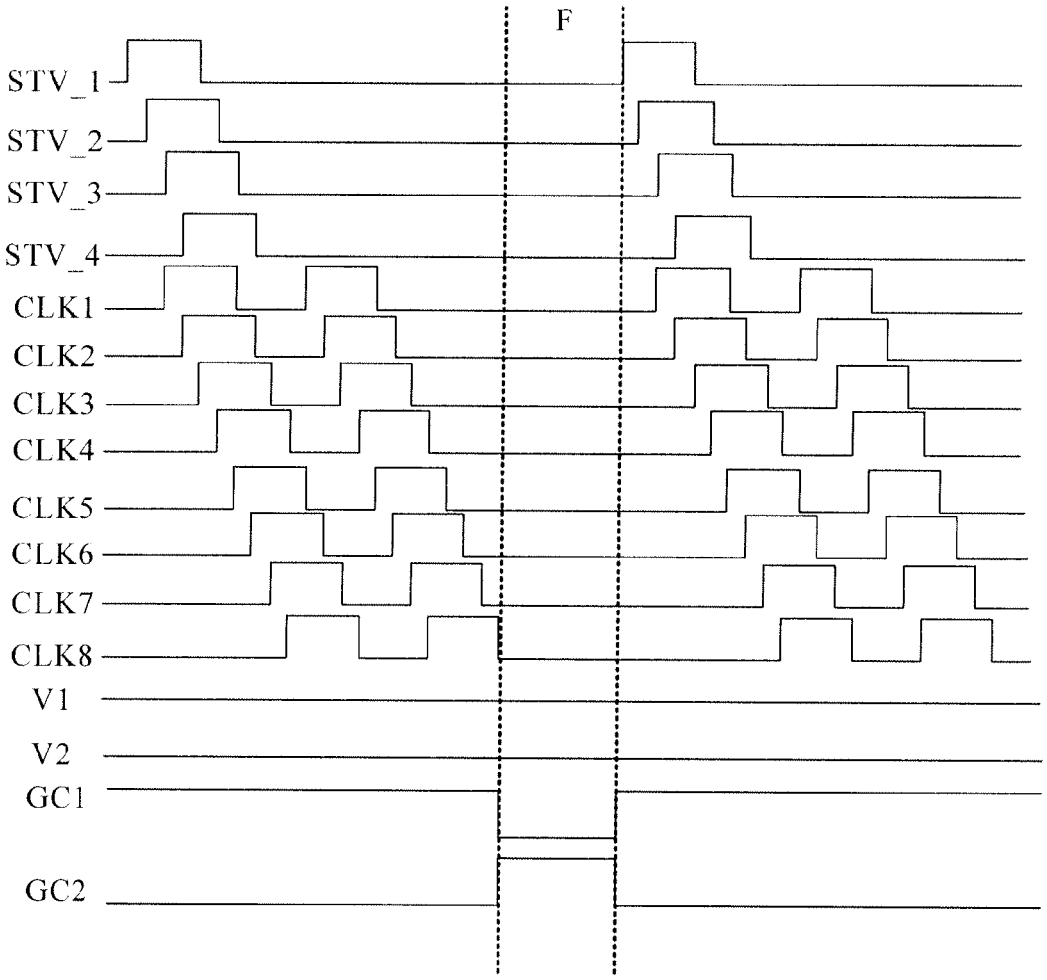
FIG. 7 is a waveform diagram of timing sequences for signals of a shift register unit provided in the embodiments of the present disclosure when scanning is performed from up to down.

Particularly, for the gate driving circuit shown in FIG. 6, when the gate driving circuit adopts a scanning manner from up to down, the waveform diagram of timing sequence of the control signals and the clock signals is shown in FIG. 7; wherein corresponding to the clock signals, the frame start signals STV likewise include a plurality of groups of frame start signals with different phase, different frame start signals are input to the first signal input terminals INPUT1 of the corresponding shift register units respectively. As shown in FIG. 7, the frame start signals include STV_1, STV_2, STV_3 and STV_4, each of frame start signals supplies a square wave during the period where its corresponding shift register unit begins to output; wherein, the F frame represents an idle state, during the time period of this frame, no signal is output from each stage of shift register unit, and the first control voltage GC1 and the second control voltage GC2 are inverted. When the gate driving circuit is controlled with such timing sequence control signals, the gate driving circuit outputs the row driving signal from G0 to Gn, that is from up to down.

Figure 8:
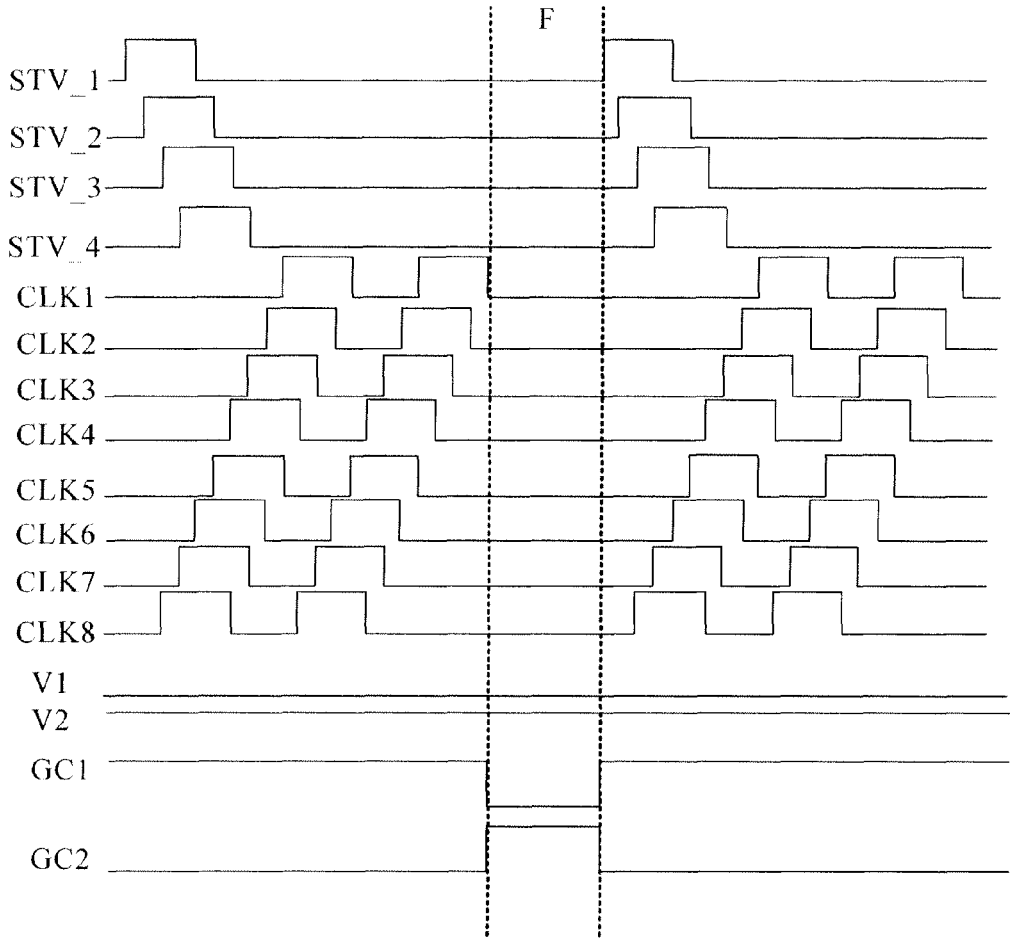
FIG. 8 is a waveform diagram of timing sequences for signals of a shift register unit provided in the embodiments of the present disclosure when scanning is performed from down to up.

When the gate driving circuit adopts a scanning manner from down to up, the waveform diagram of timing sequence of the control signals and the clock signals is shown in FIG. 8. Different from the waveform diagram of timing sequence shown in FIG. 7, the external clock signal input terminals input signals in an order from CLK8 to CLK1. When the gate driving circuit is controlled with such timing sequence control signals, the gate driving circuit outputs the row driving signal from Gn to G0, that is from down to up.

With the gate driving circuit shown in FIG. 6, the turn-on duty ratio of transistors in the shift register unit may be reduced, the circuit of the shift register unit may operate stably for a long time and may have an improved lifespan, and the power consumption of the display device product may be reduced, while the design for ensuring equal widths of two sides of the display device can be implemented. Thereby, the aesthetic appearance of the display device may be further ensured while the scanning frequency is increased, thus improving the user experience.

In the embodiments of the present disclosure, there is further provided a display device including the gate driving circuit described above.

The specific configuration of the gate driving circuit is omitted, since it has been described in detail in the above embodiments.

The display device provided in the embodiments of the present disclosure includes the gate driving circuit which in turn includes shift register units, wherein the shift register unit with such a circuit configuration can reduce the turn-on duty ratio of transistors in the shift register unit, ensure the long-term stability of the operation of the shift register unit, improve the lifespan of the shift register unit, reduce the power consumption of the display device product significantly, and improve the quality of the display device product.

The above descriptions are only for illustrating the embodiments of the present disclosure. It will be obvious that those skilled in the art may make modifications, variations and equivalences to the above embodiments without departing from the spirit and scope of the present disclosure as defined by the following claims. Such variations and modifications are intended to be included within the spirit and scope of the present disclosure.

What is claimed is:

1. A shift register unit, comprising an input module, a pull-up module, a pull-down control module and a pull-down module, wherein the input module is connected to a first signal input terminal, a second signal input terminal, a first voltage terminal, a second voltage terminal and a pull-up control node, and is used for controlling a level of the pull-up control node according to a signal input from the first signal input terminal and a signal input from the second signal input terminal, wherein the pull-up control node is a connection point of the input module and the pull-up module;

the pull-up module is connected to the pull-up control node, a clock signal input terminal and a signal output terminal, and is used for pulling up a signal output at the signal output terminal to a high level under controls of the pull-up control node and a clock signal input from the clock signal input terminal;

the pull-down control module is connected to a third voltage terminal, the pull-up control node, a first control voltage terminal and a pull-down control node, and is used for turning on the pull-down module according to the pull-up control node and a first control voltage input from the first control voltage terminal, when the shift register unit is in an idle state, the first control voltage controls the pull-down control module to be in a switch-off state, wherein the pull-down control node is a connection point of the pull-down control module and the pull-down module;

the pull-down module is connected to the pull-down control node, the pull-up control node, the third voltage terminal and the signal output terminal, and is used for pulling down the signal output at the signal output terminal to a low level; and a discharge module, which is connected to the signal output terminal, the third voltage terminal and a second control voltage terminal, and is used for discharging the shift register unit under a control of the second control voltage when the shift register unit is in the idle state.

2. The shift register unit of claim 1, wherein the input module comprises:

a first transistor having a first electrode connected to the pull-up control node, a gate connected to the first signal input terminal, and a second electrode connected to the first voltage terminal; and a second transistor having a first electrode connected to the pull-up control node, a gate connected to the second signal input terminal, and a second electrode connected to the second voltage terminal.

3. The shift register unit of claim 1, wherein the pull-up module comprises:

a third transistor having a first electrode connected to the signal output terminal, a gate connected to the pull-up control node, and a second electrode connected to the clock signal input terminal; and a capacitor connected in parallel between the gate and the first electrode of the third transistor.

4. The shift register unit of claim 1, wherein the pull-down control module comprises:

a fourth transistor having a gate and a second electrode both connected to the first control voltage terminal;

a fifth transistor having a first electrode connected to the pull-down control node, a gate connected to a first electrode of the fourth transistor, and a second electrode connected to the first control voltage terminal;

a sixth transistor having a first electrode connected to the third voltage terminal, a gate connected to the pull-up control node, and a second electrode connected to the gate of the fifth transistor; and a seventh transistor having a first electrode connected to the third voltage terminal, a gate connected to the pull-up control node, and a second electrode connected to the pull-down control node.

5. The shift register unit of claim 1, wherein the pull-down module comprises:

an eighth transistor having a first electrode connected to the third voltage terminal, a gate connected to the pull-down control node, and a second electrode connected to the pull-up control node; and a ninth transistor having a first electrode connected to the third voltage terminal, a gate connected to the pull-down control node, and a second electrode connected to the signal output terminal.

6. The shift register unit of claim 1, wherein the discharge module comprises:

a tenth transistor having a first electrode connected to the third voltage terminal, a gate connected to the second control voltage terminal, and a second electrode connected to the signal output terminal.

7. A driving method of shift register unit applied to the shift register unit of claim 1, comprising:

maintaining by the pull-down module under a control of the pull-down control module that no signal is output from the signal output terminal;

pre-charging the pull-up module by the input module according to a signal input from the first signal input terminal and a signal input from the second signal input terminal;

pulling up the shift register unit by the pull-up module according to the clock signal, such that an output signal at the signal output terminal is at a high level;

pulling down the output signal to a low level by the pull-down module under controls of the pull-down control module and the input module, after the completion of the output of the shift register unit; and controlling the pull-down control module to be in a switch-off state by the first control voltage when the shift register unit is in the idle state.

8. The method of claim 7, wherein the method further comprises:

discharging the shift register unit by the discharge module under a control of the second control voltage when the shift register unit is in the idle state.

9. The method of claim 7, wherein the first signal input terminal inputs the signal output from an adjacent previous stage of shift register unit, and the second signal input terminal inputs the signal output from an adjacent next stage of shift register unit;

when the first voltage terminal inputs a high level and the second voltage terminal inputs a low level, the high level output from the adjacent previous stage of shift register unit pre-charges the pull-up module in the present stage of shift register unit via the input module, and the high level output from the adjacent next stage of shift register unit resets the pull-up module in the present stage of shift register unit via the input module; and when the first voltage terminal inputs a low level and the second voltage terminal inputs a high level, the high level output from the adjacent next stage of shift register unit pre-charges the pull-up module in the present stage of shift register unit via the input module, and the high level output from the adjacent previous stage of shift register unit resets the pull-up module in the present stage of shift register unit via the input module.

10. A gate driving circuit comprising a plurality of stages of shift register units of claim 1.

11. The gate driving circuit of claim 10, wherein except a first stage of shift register unit, a signal output terminal of each of stages of shift register units is connected to a second signal input terminal of its adjacent previous stage of shift register unit; and except a last stage of shift register unit, the signal output terminal of each of stages of shift register units is connected to a first signal input terminal of its adjacent next stage of shift register unit.

12. The gate driving circuit of claim 11, wherein the first signal input terminal of the first stage of shift register unit inputs a frame start signal, and the second signal input terminal of the last stage of shift register unit inputs a reset signal.

13. The gate driving circuit of claim 10, wherein the shift register units for odd-numbered rows are disposed at one side of a display panel, and the shift register units for even-numbered rows are disposed at the other side of the display panel.

14. The gate driving circuit of claim 13, wherein in the shift register units for the odd-numbered rows disposed at one side of the display panel or in the shift register units for the even-numbered rows disposed at the other side of the display panel, except the first stage of shift register unit and the second stage of shift register unit, a first signal input terminal of each of stages of shift register units and a signal output terminal of a shift register unit with one stage apart are connected together.

15. The gate driving circuit of claim 14, wherein in the shift register units for the odd-numbered rows disposed at one side of the display panel or in the shift register units for the even-numbered rows disposed at the other side of the display panel, except the last two stages of shift register units, a second signal input terminal of each of stages of shift register units and a signal output terminal of a shift register unit with one stage apart are connected together.

16. The gate driving circuit of claim 13, wherein in the shift register units for the odd-numbered rows disposed at one side of the display panel or in the shift register units for the even-numbered rows disposed at the other side of the display panel, except the last two stages of shift register units, a second signal input terminal of each of stages of shift register units and a signal output terminal of a shift register unit with one stage apart are connected together.

* * * * *